US009751275B2

(12) United States Patent
van der Veld et al.

(10) Patent No.: US 9,751,275 B2
(45) Date of Patent: Sep. 5, 2017

(54) METHOD FOR ROLLING UP A SHEET, AND HOLDER FOR A ROLLED-UP SHEET

(71) Applicant: Xpozer B.V., Delft (NL)

(72) Inventors: Ivan Suwandi van der Veld, Rotterdam (NL); Clemens Leonard van Os, Zevenhuizen (NL)

(73) Assignee: XPOZER B.V., Delft (NL)

( * ) Notice: Subject to any disclaimer, the term of this patent is extended or adjusted under 35 U.S.C. 154(b) by 758 days.

(21) Appl. No.: 13/680,987

(22) Filed: Nov. 19, 2012

(65) Prior Publication Data

US 2013/0079209 A1 Mar. 28, 2013

Related U.S. Application Data

(63) Continuation of application No. PCT/NL2011/050340, filed on May 18, 2011.

(30) Foreign Application Priority Data

May 19, 2010 (NL) ..... 2004745

(51) Int. Cl.
*B31F 1/00* (2006.01)
*B65B 25/14* (2006.01)
(Continued)

(52) U.S. Cl.
CPC ..... *B31F 1/0045* (2013.01); *B65B 25/146* (2013.01); *B65B 63/04* (2013.01); *B65B 67/02* (2013.01); *B65D 85/671* (2013.01)

(58) Field of Classification Search
CPC .... B31F 1/0045; B31F 1/0009; B65D 85/671; B65D 43/169; B65D 43/24;
(Continued)

(56) References Cited

U.S. PATENT DOCUMENTS 858,639 A * 7/1907 Walker ..... B42F 9/001 281/20
1,756,356 A * 4/1930 Hill ..... B65D 5/6611 24/127
(Continued)

FOREIGN PATENT DOCUMENTS

GB 851 291 1/1957
JP 2005-047546 A 2/2005

OTHER PUBLICATIONS

PCT International Search Report mailed Aug. 18, 2011 issued in a related International Application No. PCT/NL2011/050340 by PCT International Search Authority (2 pages).

*Primary Examiner* — Thanh Truong
*Assistant Examiner* — Thomas Wittenschlaeger
(74) *Attorney, Agent, or Firm* — NLO N.V.; Catherine A. Shultz; Minerva Rivero

(57) ABSTRACT

The invention relates to an assembly of a rolled-up sheet and a holder. The rolled-up sheet has edge regions which touch each other near a first pair of opposite edges, wherein a flat end region is formed. A curved center region is rolled around a longitudinal axis to form a rolled-up end region. The holder is provided with a first support surface for supporting the flat end region of the rolled-up sheet, and with a bearing part for supporting one of the first pair of opposite edges. The holder furthermore has a clamping part which can be fixed in a holding position with respect to the first support surface in which the rolled-up sheet can be clamped between the clamping part and the first support surface.

12 Claims, 4 Drawing Sheets

(51) Int. Cl.
*B65B 63/04* (2006.01)
*B65B 67/02* (2006.01)
*B65D 85/671* (2006.01)

(58) Field of Classification Search
CPC .... B65D 83/0882; B65D 5/66; B65D 5/6602; B65D 5/6676; B65D 5/6694; B65D 5/6697; B65D 5/6611; B65D 43/16; B65D 43/162; B65D 43/163; B65D 43/164; B65D 43/20; B65D 43/22; B65D 45/14; B65B 63/04; B65B 25/146; B65B 25/14; B65B 25/141; B65B 25/145; B65B 25/148; B65B 67/02; E05D 11/10; B42F 15/0017; B42F 15/0023; B42F 15/0035; B42F 15/0041; B42F 17/22; B42F 5/06; B42F 9/001; B42F 9/007; B42F 9/008; B42F 9/002; B42F 9/004; B42F 11/02; B42F 11/04; B42F 13/002; B42F 13/0026; B42F 13/004; B42F 13/20; B42F 13/22; B42F 13/24; B42F 13/26; B42F 13/36; B65H 45/04; B65H 2405/13; B65H 2405/141; B65H 2405/1414; B65H 2405/142; B65H 2405/212; B65H 2405/311; B65H 2405/32; B65H 2405/321; B65H 2405/3211; B65H 2405/322
See application file for complete search history.

(56) References Cited

U.S. PATENT DOCUMENTS

| | | | | | |
|---|---|---|---|---|---|
| 2,825,166 | A * | 3/1958 | Flood | B42F 5/06 | 40/778 |
| 2,885,072 | A | 5/1959 | Purcell | | |
| 3,614,008 | A * | 10/1971 | Stark | B65H 39/16 | 242/325.1 |
| 4,151,787 | A * | 5/1979 | Rohr | B65H 45/04 | 206/494 |
| 5,725,310 | A * | 3/1998 | Kruczko | B65D 5/6611 | 229/117.05 |
| 5,850,960 | A * | 12/1998 | Cadwell | B65H 35/0006 | 225/58 |
| 2003/0192801 | A1* | 10/2003 | Yamaguchi | B65D 83/0882 | 206/395 |
| 2005/0072826 | A1* | 4/2005 | Sewell | B65D 83/0841 | 225/49 |

* cited by examiner

METHOD FOR ROLLING UP A SHEET, AND HOLDER FOR A ROLLED-UP SHEET

CROSS-REFERENCE TO RELATED APPLICATIONS

This is a Continuation application under 37 CFR 1.53(b) of pending International Application PCT/NL2011/050340 filed May 18, 2011, which in turn claims the benefit under 35 USC §119 of the Netherlands Patent Application Serial No. NL2004745 filed May 19, 2010, the entire contents of each of which is incorporated herein by reference.

FIELD OF THE INVENTION

The present invention relates to a method for rolling up a sheet, and to an assembly comprising a rolled-up sheet and a holder.

PRIOR ART

In the following description and claims, the term "sheet" is used to refer to a rectangular unfolded canvas or sheet. This includes, inter alia, printed matter such as photographs and posters. In addition, in the present context, this also refers to roll-up sheets without print and/or with further technical functionality. Examples thereof are coloured background sheets, projection screens, mirror sheets, thin display screens or flat flexible loudspeakers.

For a good reproduction, the sheet is preferably as flat as possible. For the purpose of transportation, however, the flat shape of the sheet is not very efficient in terms of space and susceptibility to damage.

A rectangular sheet has two pairs of opposite edges. In a known method, the edges of the first opposite pair are moved towards one another, thus producing a flat end region and a curved centre region. This method results in a sheet which is folded double without a sharp folding line, which saves some space but remains fragile.

If the material from which the sheet is made allows it, a compact rolled-up shape is more desirable. In a known method of rolling up and packaging a sheet, one edge of such a pair of edges is rolled over, so that a cylinder is created around a longitudinal axis. During the rolling-up process, the part of the sheet which has not been rolled up yet is flat and is rolled up against the outer side of the cylinder. In a side view transversely to the longitudinal axis, the resulting rolled-up sheet forms a tight-fitting spiral shape. The rolled-up sheet can be packaged in a box or tube in order to protect it during transportation.

The problem with this method of rolling-up and packaging is that the edge region which is situated inside the rolled-up sheet will curl up, which does not benefit the appearance of the illustration on the sheet in an unrolled state. In addition, hard securing parts which may optionally have been provided in an edge region of the sheet increase the risk of damage of the sheet in the rolled-up state.

U.S. Pat. No. 2,885,072 discloses a packaging means for storing and, if desired, dispensing endless tape. The endless tape illustrated therein comprises a curved centre region which is rolled up around a longitudinal axis. However, the illustrated packaging means does not show any provisions for packaging a rolled-up sheet whose edge regions along opposite sheet edges require special protection.

BRIEF DESCRIPTION

It is an object to provide a method for rolling up a sheet and a holder for such a rolled-up sheet by means of which curling up and damage of the edge regions of the sheet in the rolled-up state is prevented.

This object is achieved by providing, according to an aspect, a method for rolling up a sheet, wherein the sheet comprises a first and second pair of opposite edges, a couple of edge regions along the first pair of opposite edges, and a centre region enclosed by the second pair of opposite edges and the couple of edge regions. The method comprises moving the first pair of opposite edges towards one another, and allowing the edge regions to touch, producing a flat end region from the edge regions and a curved centre region from the centre region of the sheet. According to the method, the curved centre region is then rolled up in a direction of the flat end region, with a rolled-up end region being produced around a longitudinal axis. The flat end region is placed on a first support surface of a holder, the first pair of opposite edges being placed against a bearing part of the holder. Subsequently, the rolled-up sheet is clamped between the first support surface and a clamping part which is fixed in a holding position with respect to the first support surface.

This way of rolling up the sheet prevents the edge regions from being part of the rolled-up end region of the sheet. Due to the edge regions remaining flat during rolling up, they are prevented from curling up. By placing the flat end region on a first support surface of the holder during the rolling up of the sheet, with the first pair of opposite edges against the bearing part, the eventually rolled-up sheet does not have any freedom of rotation in the first support surface. By then clamping the rolled-up sheet between the first support surface and the clamping part, the freedom of translation is also blocked. The rolled-up sheet is thus clamped motionless in the holder. Any securing parts which are attached to the sheet in the edge regions then cannot damage the sheet.

In accordance with the above advantages, according to an aspect, an assembly of a rolled-up sheet, with a first and second pair of opposite edges, two edge regions along the first pair of opposite edges, and a centre region enclosed by the second pair of opposite edges and the two edge regions is provided, wherein the edge regions touch each other near the first pair of opposite edges and form a flat end region, and a holder for enclosing at least a part of the rolled-up sheet, wherein the holder is provided with a first support surface for supporting a flat end region of the rolled-up sheet. The rolled-up sheet has a curved centre region which is rolled up around a longitudinal axis to form a rolled-up end region. The holder is furthermore provided with a bearing part for supporting at least one of a first pair of opposite edges of the rolled-up sheet, and with a clamping part which can be fixed in a holding position with respect to the first support surface in which the rolled-up sheet can be clamped between the clamping part and the first support surface.

According to an embodiment of the assembly, the clamping part, in the holding position, leaves an opening, which extends across a clamp width Bk and parallel to a surface width Bv, between the clamping part and the first support surface. This opening has a sufficient opening height Ho for rolling up the curved centre region of the sheet in a direction of the flat end region through the opening and into a rolled-up sheet clamped in the holder.

Such an opening between the first support surface and the clamping part makes it possible to accommodate the sheet via a rolling-up movement in the holder, without this requiring any movability of the clamping part. This makes it possible to produce a strong holder out of one piece. The rolled-up sheet can be removed from the holder in a simple manner by manually reducing the diameter of the roll and rolling the rolled-up sheet out of the holder via the opening.

According to an embodiment of the assembly, the clamping part, along the surface width Bv, leaves access spaces open having a recess width Bu of at least 2 cm.

Such access spaces offer space in order to roll the sheet into the holder beneath the clamping part using the fingers, resulting in the rolled-up sheet being clamped into the holder. Larger access spaces offer the possibility of using the hands to roll the sheet into the holder.

According to an embodiment of the assembly, the first support surface, near the bearing part, is provided with accommodation spaces for accommodating securing parts fitted on a flat end region of the rolled-up sheet.

The flat end region of the rolled-up sheet accommodated in the holder can thus remain flat on the first support surface, since securing parts which extend with respect to the sheet will fall into the accommodation spaces.

According to an embodiment, the holder of the assembly also comprises a box-shaped casing which can accommodate the rolled-up sheet.

The rolled-up sheet in a holder with a box-shaped casing has a compact shape and can be transported in such a way that it can resist impact and weather conditions.

SHORT DESCRIPTION OF THE FIGURES

There now follows a description of embodiments of the invention, only given by way of example, with reference to the accompanying diagrammatic drawings in which similar parts are denoted by the same reference numerals, in which.

The drawings are only intended to serve illustrative purposes and not to limit the scope of protection which is defined in the claims.

DETAILED DESCRIPTION

FIGS. 1A-1D illustrate a rolling-up method for a sheet according to an embodiment.

Figure 1B:
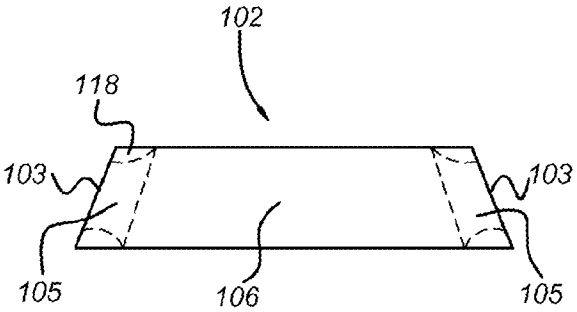
FIGS. 1A-1D show a method for rolling up a sheet according to an embodiment.
Figure 1D:
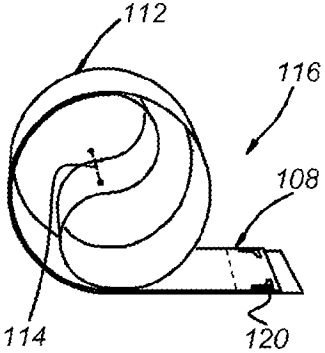
Figure 1A:
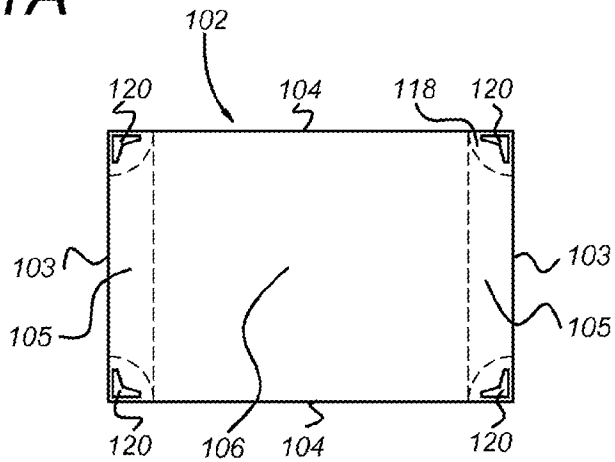

FIGS. 1A and 1B show a rear view and a perspective view of a rectangular sheet 102 with a first pair of opposite edges 103 and a second pair of opposite edges 104. Along each edge of the first pair of opposite edges 103, there is an edge region 105, which takes up a part of the surface of the sheet 102. Between these edge regions 105 and the second pair of opposite edges 104, there is a centre region 106 which takes up the remaining surface of the sheet 102.

Figure 1C:
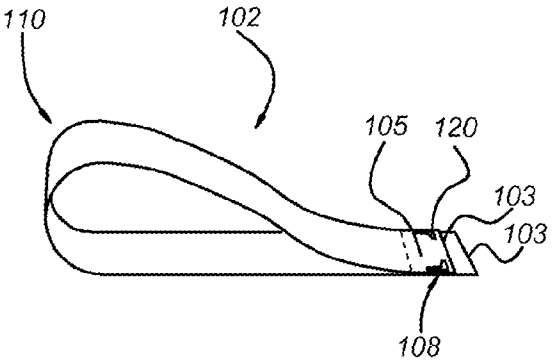

FIG. 1C illustrates the result of moving the first pair of opposite edges 103 towards one another according to a first step of the method. According to the illustrated result, the edge regions 105 touch each other near the first pair of opposite edges 103. The touching edge regions 105 together form a flat end region 108 and folding the centre region 106 results in a curved centre region 110.

FIG. 1D shows how the curved centre region 110 is then rolled up in a direction of the flat end region 108. Rolling up is carried out in such a manner that a rolled-up end region 112 is produced by the curved centre region 110 which is rolled up around a longitudinal axis 114. This longitudinal axis 114 forms the centre of rotation of the rolled-up end region 112, but does not necessarily have to correspond to a physical point on the rolled-up sheet 116. The flat end region 108 and the rolled-up end region 112 together form the rolled-up sheet 116.

Furthermore, FIGS. 1A-1D show securing parts 120 which, if desired, may be arranged on corner regions 118 of the sheet 102 (and the rolled-up sheet 116). These securing parts 120 may, for example, be arranged there in order to suspend and/or pull the sheet 102 taut, so that the print or the image on the sheet 102 in the unrolled state can be shown in as flat a state as possible. In the unrolled state, the sheet 102 with securing parts 120 can be combined with further suspension means, so that the sheet 102 can be hung on a wall, from a ceiling or stand. The securing parts 120 can also be arranged along a part of or the entire width of at least one of the first pair of opposite edges 103 (not shown). If the securing parts 120 are arranged on one side of the sheet 102, then folding the first pair of opposite edges 103 towards one another preferably has to take place on the other side of the sheet 102. As is illustrated in FIG. 1C, the securing parts 120 end on the outer sides of the end region 108 in this way, so that damage of the sheet 102 as a result of the abrasive action of the securing parts 120 is prevented.

The above-described method of rolling up the sheet 102 prevents the edge regions 105 from curling up and thus prevents any securing parts 120 which may have been arranged on the sheet 102 from ending up inside the rolled-up sheet 116 during rolling up and thus damaging the latter.

Figure 2B:
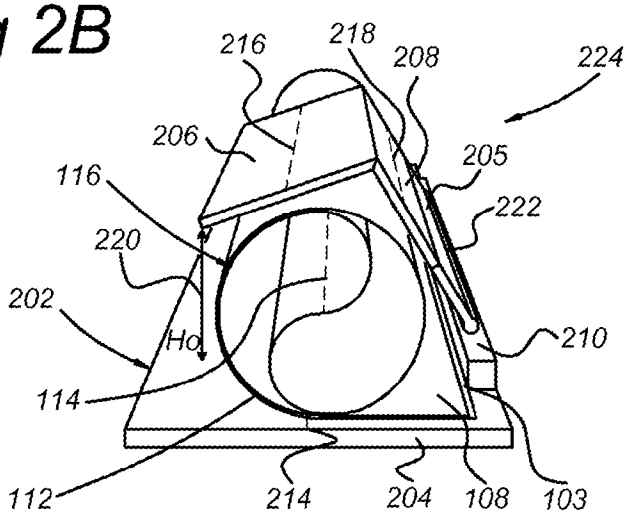
FIGS. 2A-2C show an assembly of a holder and a rolled-up sheet according to an embodiment.
Figure 2A:
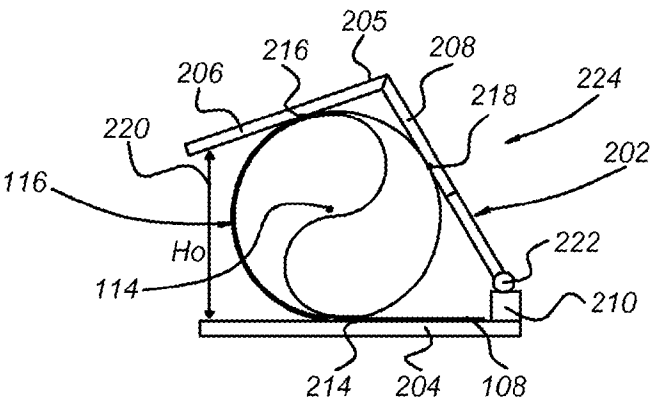
Figure 2C:
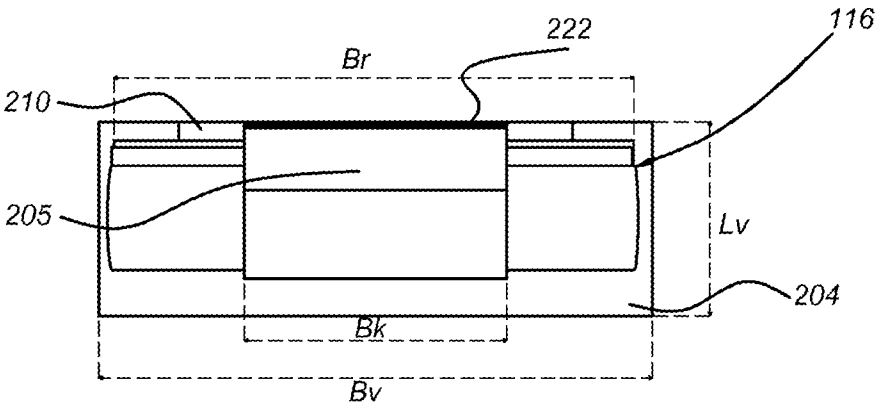

FIGS. 2A-2C show a side view, perspective view and top view of an assembly 224 of a holder 202 and a rolled-up sheet 116 according to an embodiment. The holder 202 for enclosing at least a part of the rolled-up sheet 116 serves to keep the rolled-up sheet 116 in the rolled-up state, and can also serve as a (partly) protective packaging for the rolled-up sheet 116. This packaging function of the holder 202 is explained in more detail with reference to FIG. 4. The holder may be made of, for example, folded cardboard, dried paper pulp, plastic or another suitable material.

As is shown, the holder 202 comprises a first support surface 204, a bearing part 210 on a side of the first support surface 204, and a clamping part 205 which can be brought into a fixed position with respect to the first support surface 204. The first support surface 204 is suitable for supporting the flat end region 108 of the rolled-up sheet 116. As is illustrated in FIG. 2C, the first support surface 204, for the purpose of said supporting function, may have a first surface width Bv which is equal to or greater than a roll width Br of the rolled-up sheet 116.

The bearing part 210 is suitable for supporting at least one of the first pair of opposite edges 103 of the rolled-up sheet 116, if present in the holder 202. Preferably, the bearing part 210 has a linear part along which at least a part of the first pair of opposite edges 103 of the rolled-up sheet 116 can be arranged. The bearing part 210 may, for example, be formed by a beam or an upright edge or surface arranged along a side of the first support surface 204.

The clamping part 205 can be fixed in a holding position with respect to the first support surface 204. In this holding position, the rolled-up sheet 116 can be clamped between the clamping part 205 and the first support surface 204. The rolled-up sheet 116 can thus be clamped efficiently by the holder 202 and be held in a rolled-up state, which facilitates further packaging and transportation.

As is illustrated in FIGS. 2A-2C, the clamping part 205 may be permanently attached to the holder 202. This attachment may be a rigid or a pivot arrangement. According to an embodiment of the assembly 224 in FIGS. 2A-2C, the clamping part 205 is attached so as to be able to pivot with respect to the first support surface 204 about a pivot axis 222 parallel to the first support surface 204. The clamping part 205 can thus pivot between the holding position in which the rolled-up sheet 116 can be clamped between the clamping part 205 and the first support surface 204, and an open position in which the rolled-up sheet 116 is not clamped.

If the rolled-up sheet 116 is accommodated in the holder 202, the clamping part 205 can be fixed in the holding position, in which case the pivotability is temporarily blocked. To this end, the clamping part 205 may be provided with a temporary securing means.

Alternatively, the clamping part 205 may also be secured in a permanent manner with respect to the first support surface 204 in the holding position. In this case, the clamping part 205 can be a fixed part of the holder 202, which fixed part is rigid with respect to the first support surface 204. Equally, the clamping part 205 may be a separate part, made of, for example, expanded polystyrene, folded cardboard, dried paper pulp, plastic or another suitable material. Such a clamping part 205 may be configured to be clamped in a permanent manner in the holding position with respect to the first support surface 204 in the recesses provided in the holder 202 for this purpose (see also FIG. 4).

In FIGS. 2A-2C, the clamping part 205 is provided with two support surfaces 206, 208 which are neither parallel to one another nor with respect to the first support surface 204. These two support surfaces 206, 208 are configured to support the rolled-up sheet 116 along at least two non-coinciding support regions 216, 218 situated on the outer sides of the rolled-up sheet 116. These support regions 216, 218 may, for example, be supporting points, supporting lines and/or curved support surfaces. In FIG. 2B, the two support regions are shown as two support lines 216, 218 which neither coincide with each other nor with the first support surface 204. Here, the two supporting lines 216, 218 are parallel to the longitudinal axis 114 of the rolled-up end region 112 of the rolled-up sheet 116.

In other embodiments, the clamping part 205 may have more than two support surfaces, in which case the support regions may vary in number and form. Arbitrary combinations of supporting points, supporting lines and curved support surfaces are possible. Thus, the clamping part 205 is not necessarily solely made up of support surfaces 206, 208, but may additionally or alternatively comprise curved parts which closely adjoin the expected curvature of the rolled-up sheet 116.

The assembly 224 of the rolled-up sheet 116 and the holder 202 is formed by accommodating the sheet 102 in the holder 202. To this end, additional steps are provided during rolling up of the sheet 102 in order to accommodate the rolled-up sheet 116 in the holder 202. According to an embodiment, the method for rolling up the sheet 102 furthermore comprises placing the flat end region 108 of the sheet 102 on the first support surface 204 of the holder 202, in which case the first pair of opposite edges 103 is placed against a bearing part 210 of the holder 202. Then, the rolled-up sheet 116 is clamped between the first support surface 204 and the clamping part 205, which is fixed in a holding position with respect to the first support surface 204.

According to further embodiments, the rolling up of the sheet 102 may take place in various ways.

Figure 3B:
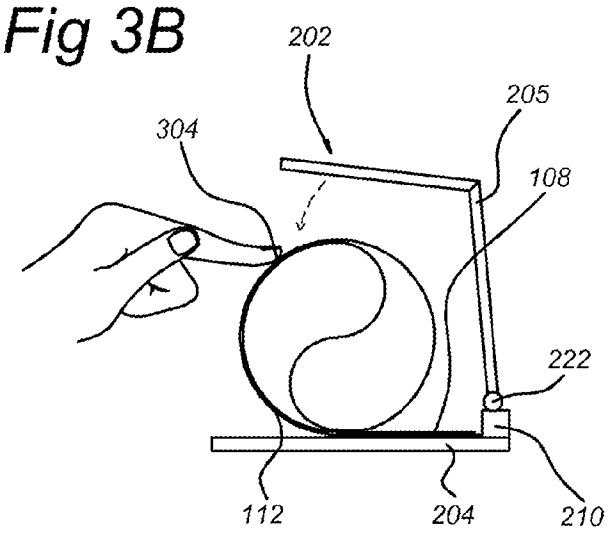
FIGS. 3A-3D show the method for rolling up the sheet according to further embodiments.
Figure 3A:
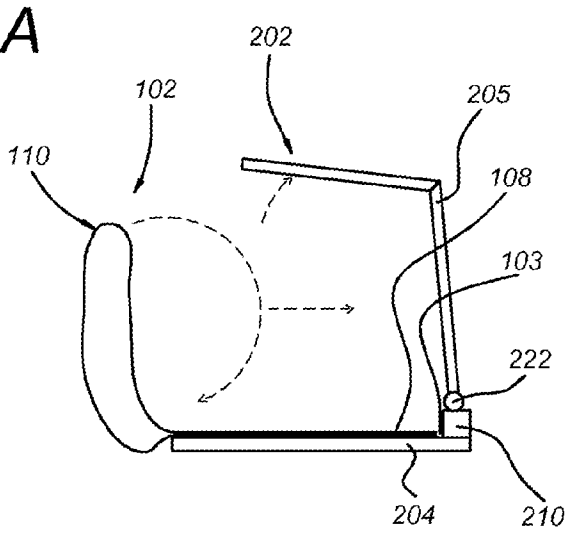

Firstly, the clamping part 205 according to an above-described embodiment of the assembly 224 may be pivotably attached with respect to the first support surface 204, about the pivot axis 222 parallel to the first support surface 204. The clamping part 205 is in this case configured to pivot between the holding position and an open position which does not have a clamping function in this embodiment, the clamping part 205 can initially be placed in the open position, as is illustrated in FIG. 3A. The sheet 102 can then, once the first pair of opposite edges 103 have been moved towards one another, be placed with the flat end region 108 on the first support surface 204 and with at least one first edge 103 against the bearing part 210 of the holder 202. Thereafter, the curved centre region 110 of the sheet 102 is rolled up in the direction of the bearing part 210. Using a temporary support means 304 which does not form part of the holder 202, for example the palm of a hand or a finger, the rolled-up sheet 116 is held in the rolled-up configuration, as is illustrated in FIG. 3B. Subsequently, the clamping part 205 can be placed in a holding position by means of a pivoting movement. The rolling up of the sheet 102 can again be carried out before the rolled-up sheet 116 is placed with the first opposite edges 103 against the bearing part 210.

Figure 3D:
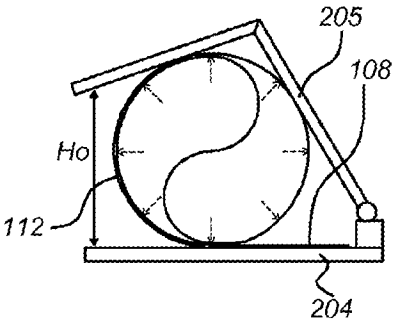
Figure 3C:
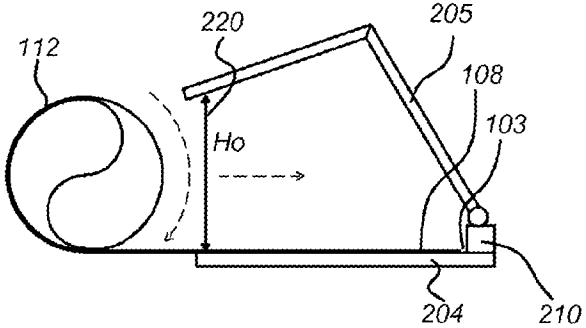

A second embodiment of the rolling-up method is illustrated in FIGS. 3C and 3D. According to an embodiment of the assembly 224, the clamping part 205 fixed in the holding position may leave an opening 220 between the clamping part and the first support surface 204, which opening 220 has an opening height Ho and extends across the entire clamp width Bk and parallel to the surface width Bv. The opening height Ho may be sufficiently large to allow rolling up of the curved centre region 110 of the sheet 102 in a direction of the flat end region 108 through the opening 220. According to the embodiment of the rolling-up method in FIGS. 3C and 3D, rolling up the sheet 102 and placing it in the holder 202 furthermore comprises rolling up the curved centre region 110 of the sheet 102 through the opening 220 between the clamping part 205 and the first support surface 204. In this case, the folded sheet 102 with the flat end region 108 is first placed on the first support surface 204 of the holder 202, and then the curved centre region is rolled in a tightly fitted manner underneath the clamping part 205 which is fixed in the holding position to form a rolled-up sheet 116. Due to the tensioning forces in the rolled-up sheet 116, releasing the rolled-up sheet 116 will cause a radial enlargement of the rolled-up end region 112, so that the rolled-up sheet 116 locks itself between the first support surface 204 and the clamping part 205 in the holding position, as is illustrated in FIG. 3D.

Figure 4:
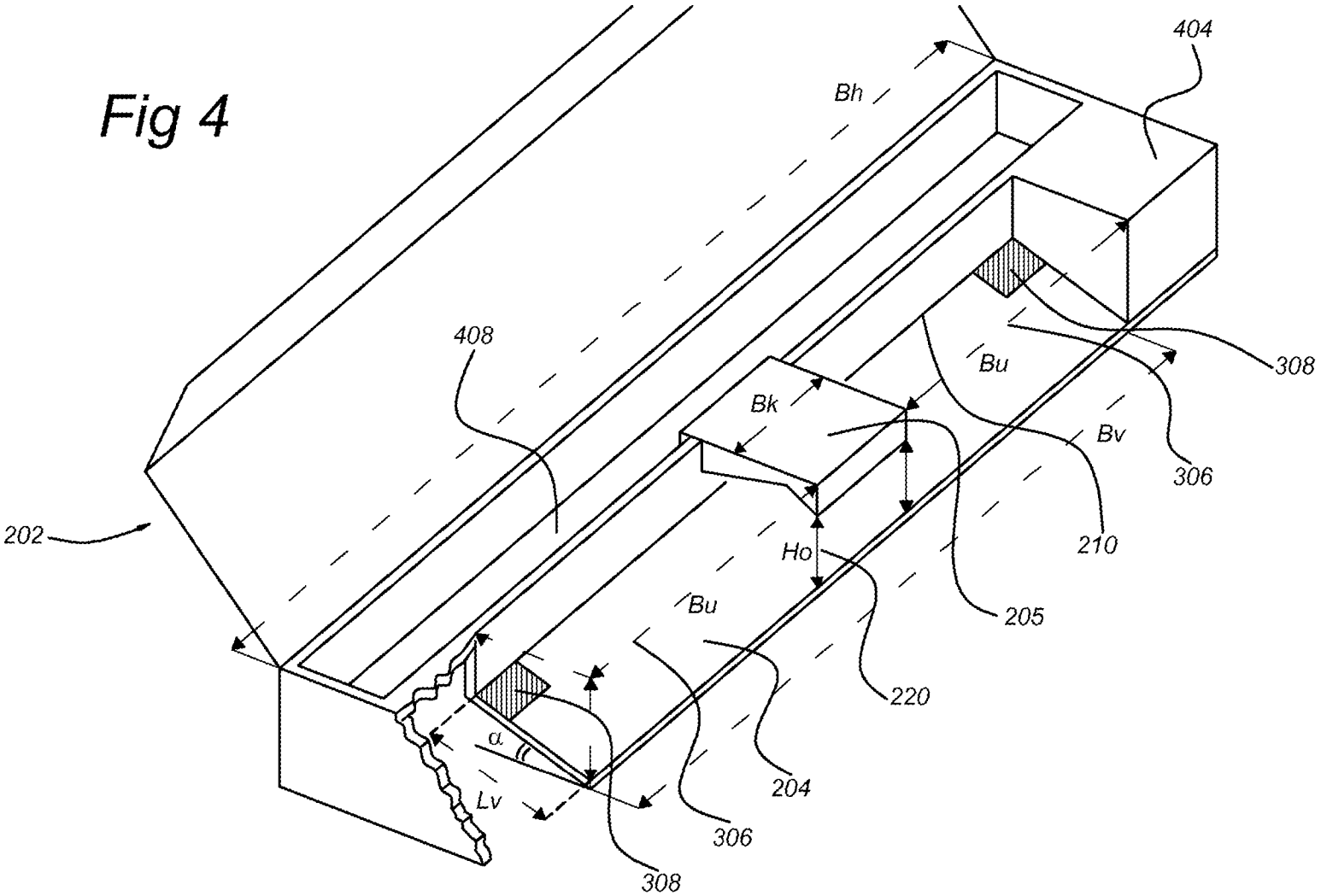
FIG. 4 shows an assembly of a rolled-up sheet and a holder according to a further embodiment.

FIG. 4 shows a holder 202 in which the clamping part 205 leaves access spaces 306 having a recess width Bu open along the surface width Bv. These access spaces 306 correspond to clamp-free regions in which the rolled-up sheet 116 will not be subjected to a clamping action of the holder 202. For the sake of clarity, the rolled-up sheet 116 having a roll width Br has not been shown in FIG. 4, but can be assumed to be accommodated in the holder 202, analogous to the top view in FIG. 2C.

As is illustrated in FIG. 4, the clamping part 205 may be centred around the centre of the first support surface 204, and leave a couple of access spaces 306 at two ends of the clamping part 205. The clamping part 205 here has a clamp width Bk which is smaller than the roll width Br of the rolled-up sheet 116.

Equally, the clamping part 205 may leave intermediate access spaces 306 having recess widths Bu open (not shown). Such an intermediate access space can be formed by a recess provided in the clamping part 205. The total clamp width Bk of a clamping part 205 having intermediate access spaces 306 is not necessarily smaller than the roll width Br of the rolled-up sheet 116.

The described access spaces 306 with recess widths Bu leave space for the sheet 102 to be rolled into the holder 202 underneath the clamping part 205 using the fingers or the hands, resulting in the rolled-up sheet 116 clamped in the holder 202, as is illustrated, for example, in FIG. 3D. The access spaces 306 may have recess widths Bu equal to the width of a few fingers (1-2 cm) in order to roll in the sheet 102 using a few fingers. Equally, one or more access spaces 306 may have a recess width Bu equal to the width of a hand (5-10 cm) in order to roll in the sheet 102 using a hand underneath the clamping part 205.

FIG. 4 shows that the first support surface 204 of the holder 202 may be provided with accommodation spaces 308 near the bearing part 210. These accommodation spaces 308 in the first support surface 204 are configured to accommodate the securing parts 120 which are optionally provided on the flat end region 108 of the rolled-up sheet 116, as is illustrated in FIG. 1A. As a result thereof, the flat end region 108 of the rolled-up sheet 116 may remain flat when it is accommodated in the holder 202, as the projecting securing parts 120 fall into the accommodation spaces 308. If the accommodation spaces 308 in the first support surface and the securing parts 120 are identical in form, then this will improve the fixing of the rolled-up sheet 116 in the holder 202.

FIG. 4 furthermore shows that the first support surface 204 can make an angle $\alpha$ with the horizontal along a surface length Lv and at right angles to the surface width Bv. The horizontal is in this case defined as the surface at right angles to the local gravity vector. The practically useful range for this angle $\alpha$ can be defined as $0° < \alpha \leq 45°$. The value of $\alpha$ is substantially determined by an expected thickness of the securing parts 120 which may optionally be arranged on the flat end region 108 of the sheet 102. This expected thickness corresponds to the dimensions of a securing part 120 at right angles to the surface of the sheet 102. As a result of a gradient at an angle $\alpha$, the first support surface 204 comes to lie higher with respect to the horizontal at the location of the accommodation spaces 308 than a remaining part of the first support surface 204. The accommodation spaces 308 thus offer a sufficient accommodation depth for the securing parts 120.

FIG. 4 furthermore shows that the holder 202 may have a box-shaped casing 404 which may enclose the rolled-up sheet 116. The box-shaped casing 404 may in this case be configured so as to form an integral part of the holder 202, for example as a collection of at least eight joined faces 408 which are pivotable with respect to one another. In this case, at least six faces form an outer side of a block-shaped or prismatic casing. In addition, at least two faces form the first support surface 204 and the bearing part 210. Other configurations of the box are possible.

Alternatively, the holder 202 may be detachable with respect to the box-shaped casing 404. The holder 202 then forms a detachable insert which can be pushed into the box-shaped casing 404. In this case, the holder 202 may have further storage spaces 408. Such a storage space 408 may, for example, be provided across the entire holder width Bh of the holder 202, as is illustrated in FIG. 4. In such an elongate storage space 408, it is possible to store, for example, elongate, mounting parts of a modular mounting system for virtually flatly mounting the sheet 102 (not shown). Such a holder 202 with a box-shaped casing 404 and further storage spaces 408 forms an efficient packaging for the combination of a rolled-up sheet 116 and an associated mounting system for mounting a sheet 102.

It will be clear that the above-described embodiments have only been described by way of example and not in any way as a limitation, and that various changes and modifications are possible without departing from the scope of the invention and that the scope is only determined by the attached claims.

LIST OF REFERENCE NUMERALS

102 sheet
103 first opposite edge
104 second opposite edge
105 edge region
106 centre region
108 flat end region
110 curved centre region
112 rolled-up end region
114 longitudinal axis
116 rolled-up sheet
118 corner region
120 attachment part
202 holder
204 first support surface
205 clamping part
206 second support surface
208 third support surface
210 bearing part
214 first support region
216 second support region
218 third support region
220 opening
222 pivot axis
224 assembly
Bv surface width
Bk clamp width
Br roll width
Ho opening height
304 temporary support means
306 access space
308 accommodation space
Bu recess width
404 box-shaped casing
408 storage space
Bh holder width

The invention claimed is:

1. A method for rolling up a sheet, wherein the sheet comprises a first and second pair of opposite edges, two edge regions along the first pair of opposite edges, and a centre region enclosed by the second pair of opposite edges and the two edge regions, the method comprising:

moving the first pair of opposite edges towards one another, and allowing the edge regions of said first pair of opposite edges to touch, producing a flat end region from the two edge regions of said first pair of opposite edges and a curved centre region from the centre region of the sheet such that there are no creases in the sheet;

rolling up the curved centre region in a direction of the flat end region produced from said edge regions of said first pair of opposite edges, with a rolled-up end region being produced around a longitudinal axis;

placing the flat end region on a first support surface of a holder, the first pair of opposite edges being placed against a bearing part of the holder; and clamping the rolled-up sheet between the first support surface and a clamping part which is fixed in a holding position with respect to the first support surface.

2. The method according to claim 1, wherein rolling up the curved centre region in a direction of the flat end region of the sheet comprises: rolling up the curved centre region through an opening between the clamping part and the first support surface, wherein the opening extends across a clamp width Bk of the clamping part and parallel to a surface width By of the first support surface, and wherein clamp width Bk is less than the surface width Bv.

3. An assembly comprising:

a rolled-up sheet with no creases, the rolled up sheet comprising: a first and second pair of opposite edges, two edge regions along the first pair of opposite edges, and a centre region enclosed by the second pair of opposite edges and the two edge regions, wherein the edge regions touch each other near the first pair of opposite edges and form a flat end region, the curved centre region of the rolled-up sheet being rolled up around a longitudinal axis to form a rolled-up end region and a holder, comprising a first support surface, a bearing part and a clamping part, wherein the rolled-up sheet is at least partly enclosed in the holder with the first support surface supporting the flat end region of the rolled-up sheet, the bearing part supporting at least one of a first pair of opposite edges of the rolled-up sheet, wherein the clamping part is pivotably attached with respect to the first support surface, and is configured to pivot between the holding position and an open position, in which the rolled-up sheet cannot be clamped between the clamping part and the first support surface, and wherein the clamping part, in the holding position, leaves an opening, which extends across a clamp width Bk and a parallel to a surface width Bv of the first support surface, between the clamping parting and the first support surface, wherein the opening has a sufficient opening height Ho for rolling up the curved centre region of the sheet in a direction of the flat end region through the opening and into a rolled-up sheet clamped in the holder, and wherein clamp width Bk is less than the surface width Bv.

4. The assembly according to claim 3, wherein the clamping part comprises at least two support surfaces configured to support the rolled-up sheet along at least two non-coinciding support regions situated on the outer sides of the rolled-up sheet, wherein the support surfaces are neither parallel to one another nor with respect to the first support surface.

5. The assembly according to claim 4, wherein the clamping part, along the surface width By, leaves access spaces having recess widths Bu of at least 2 cm.

6. The assembly according to claim 4, wherein the clamping part is placed permanently in the holding position with respect to the first support surface.

7. The assembly according to claim 3, wherein the clamping part, along the surface width By, leaves access spaces having recess widths Bu of at least 2 cm.

8. The assembly according to claim 3, wherein the clamping part can be fixed in the holding position.

9. The assembly according to claim 3, wherein the clamping part is placed permanently in the holding position with respect to the first support surface.

10. The assembly according to claim 3, wherein the rolled-up sheet comprises securing parts arranged on corner regions of a single side of the rolled-up sheet.

11. The assembly according to claim 3, wherein the first support surface, near the bearing part, is provided with accommodation spaces configured for accommodating securing parts provided on at least one edge region of the rolled-up sheet.

12. The assembly according to claim 3, wherein the holder comprises a box-shaped casing in which the rolled-up sheet can be accommodated.

* * * * *